US010039371B2

(12) United States Patent
Horn

(10) Patent No.: US 10,039,371 B2
(45) Date of Patent: Aug. 7, 2018

(54) EMULSION METHOD FOR CLEANING PAINT BRUSHES

(71) Applicant: Stephen T. Horn, White Stone, VA (US)

(72) Inventor: Stephen T. Horn, White Stone, VA (US)

( * ) Notice: Subject to any disclaimer, the term of this patent is extended or adjusted under 35 U.S.C. 154(b) by 8 days.

(21) Appl. No.: 15/530,988

(22) Filed: Apr. 3, 2017

(65) Prior Publication Data

US 2018/0160797 A1 Jun. 14, 2018

Related U.S. Application Data

(60) Provisional application No. 62/498,088, filed on Dec. 14, 2016.

(51) Int. Cl.

| | |
|---|---|
| ***B08B 3/00*** | (2006.01) |
| ***A46B 17/06*** | (2006.01) |
| ***B08B 7/00*** | (2006.01) |

(52) U.S. Cl.
CPC ..... *A46B 17/06* (2013.01); *B08B 7/0014* (2013.01)

(58) Field of Classification Search
None
See application file for complete search history.

(56) References Cited

U.S. PATENT DOCUMENTS 2,666,976 A * 1/1954 Olmer ..... D01F 6/18 15/207.2
3,112,505 A * 12/1963 Hirst ..... B05C 21/00 134/6
5,024,705 A * 6/1991 Cahill ..... A46B 17/06 134/143

* cited by examiner

*Primary Examiner* — Eric W Golightly

(57) ABSTRACT

The present invention describes a method and apparatus for cleaning paint brushes or paint rollers with an encapsulating fluid that can transmit hydraulic force to the paint attached to the fibers of the roller or the bristles of the brush, such that the paint becomes broken into pieces and encapsulated by the encapsulating fluid and then removed from the paint applicator.

2 Claims, 5 Drawing Sheets

EMULSION METHOD FOR CLEANING PAINT BRUSHES

1. FIELD OF THE INVENTION

The present invention describes a liquid paint removal method for paint brushes or rollers.

2. BACKGROUND

Paint brushes are used for applying various liquids for many purposes such a painting, applying glue or paint stripper and others. Cleaning the brush is necessary to save the brush upon completing the particular job. Often cleaning a brush involves considerable amounts of solvents and thus creating a potential environmental problem. The material being applied by the brush or roller if not removed clogs and contaminates the bristles preventing further use of the applicator.

No suitable method of removing this contamination without the use of solvents is available.

3. SUMMARY OF THE INVENTION

The present invention is a method of cleaning paint brushes and rollers. The method incorporates in principle a non solvent method where a liquid breaks up and then encapsulates paint, glue, stain, or any contaminant on the bristles of the brush where it can then be removed with a paper towel. The non solvent encapsulating fluid for latex paint as an example could be common vegetable oil, including but not limited to canola oil or corn oil. Some other fluids that encapsulate common paint are brake fluid, hydraulic fluid, power steering fluid or even motor oil. The best fluids are non-solvents for the particular material to be removed. Each material that is to be encapsulated and removed has its own best encapsulating fluid. It is therefore impossible to list all possible encapsulating fluid formulas. Canola oil in combination with a liquid soap works well with some latex paints. Water soluble oil is another formula which includes an encapsulating fluid and a soap which would be chosen for some paints or glues.

Further objects and advantages of my invention will become apparent from a consideration of the drawings and ensuing description.

4. BRIEF DESCRIPTION OF THE DRAWINGS

Reference will now be made to the accompanying drawings, which are not necessarily drawn to scale. The following detailed description of the disclosure will be better understood when read in conjunction with the appended drawings. It should be understood, however, that the disclosure is not limited to the precise arrangements and instrumentalities shown. In the drawings.

5. DETAILED DESCRIPTION OF THE DISCLOSURE

Figure 1:
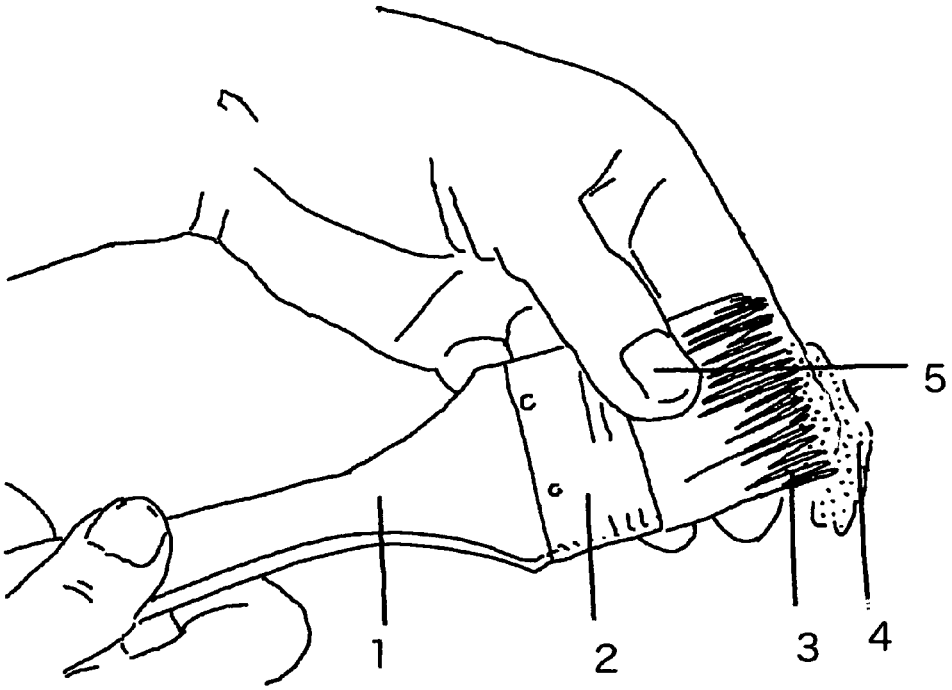
FIG. 1 is a drawing of a paintbrush being cleaned.
Figure 2:
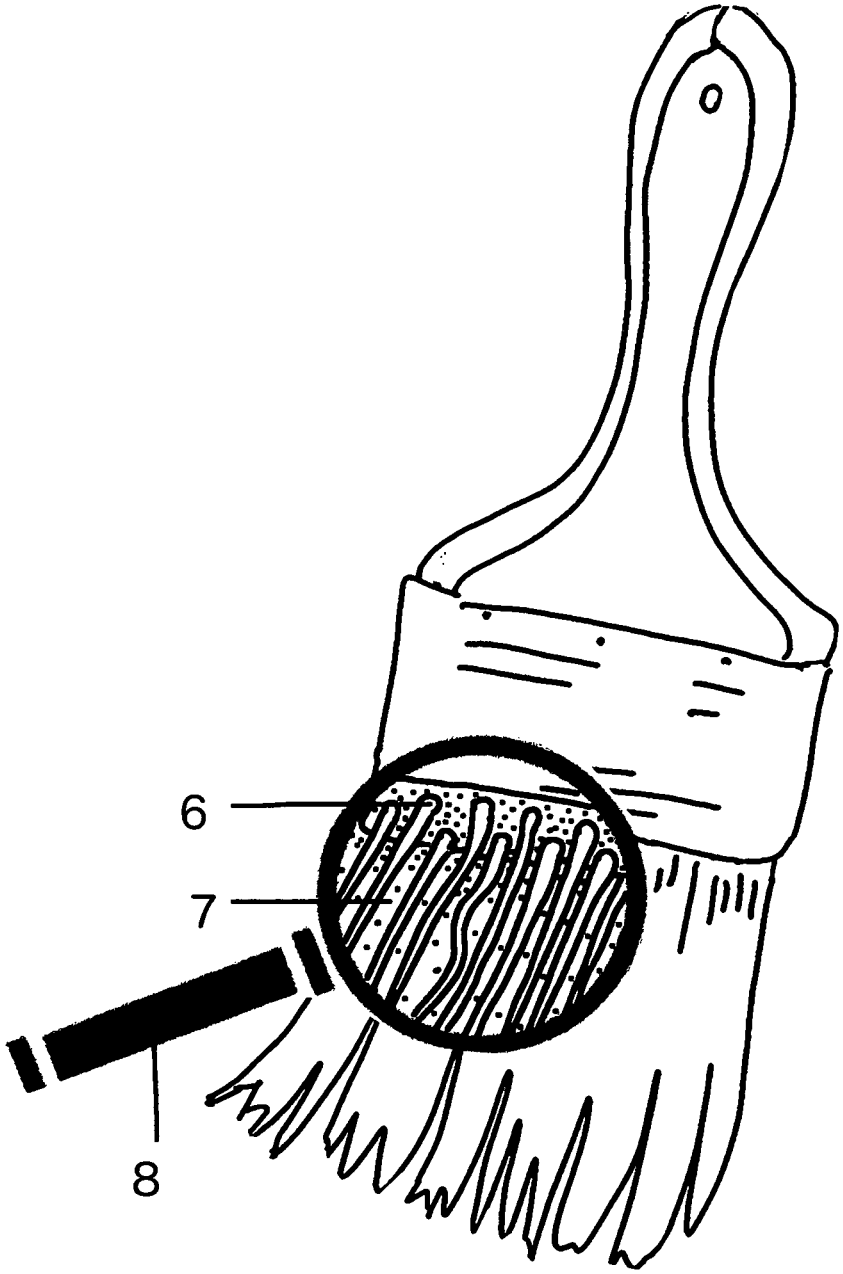
FIG. 2 is a drawing illustrating the advantage of having tapered bristles to more efficiently move paint particles toward the brush tip.

For removing latex paint, the action of wiping or massaging FIG. 1 number 5 vegetable oil, which is the non solvent encapsulating fluid used in this case FIG. 1 number 4, on to the brush bristles FIG. 1 number 3 which then breaks the paint into pieces FIG. 2 number 7 that are then surrounded by the fluid that floats or flows the paint particles off the bristles and they then can be captured with a paper towel if desired.

The tapered nature of the bristles FIG. 2 number 6 on a paint brush helps this to occur by directing the flow of the loosened particles toward the tip of the brush away from the handle FIG. 1 number 1. The flow of the paint particles towards the tip of the brush is due to the multiple tapered wedge like brush bristles where the thick end of the individual bristles are held by the brush ferrule FIG. 1 number 2 where there is less room for particles than toward the tip of the brush, this urges the paint particles toward the tip of the brush FIG. 2 number 8 shows a magnifier showing the paint particles flowing away from the ferrule along the tapered brush bristles toward the brush tip.

When the brush is squeezed or massaged by the paper towel (or any other suitable absorbent material) or just the thumb, the paint particles are forced from the confined area next to the brush ferrule to the less confined area toward the brush tip. The taper forces particles to collect behind other paint particles attached to the bristles until the attached particle shears from the brush bristle. The hammering action or hydraulic action provided by the force of the spray application and the manipulation of the thumb or finger or paper towel or like object moving the encapsulating fluid, upon stripping the paint from the bristles then replaces the paint with the non solvent encapsulating fluid and hinders the re-attachment of the paint particles.

The force or hydraulic action is transferred by the non compressibility of the non solvent encapsulating material. The paint particles are ultimately forced to the brush tip and onto the paper towel where it is collected and discarded thus cleaning the paint brush. It should not be presumed that a paper towel is necessary for the present invention, the paper towel is mentioned as just a convenience to keep from making a mess and keeping the hand clean.

The encapsulating fluid remains to some extent on the brush fibers protecting them from any residual contaminant that remains. A low or non volatile encapsulating fluid is preferable in that it does not evaporate readily or quickly where it could re attach said paint to the bristles. Said encapsulating fluid can be subsequently removed if necessary with soap and water in the preferred embodiments of the invention.

This said fluid performs better if it is non compressible such as hydraulic fluid with a high bulk modulus whereby the application of spraying or applying the suspending fluid or the massaging of the brush bristles with the hand or paper towel or some absorbent or otherwise material or object, transfers the hydraulic force through the suspending liquid to the paint to break it away from the solid bristles of the brush/roller.

Figure 3:
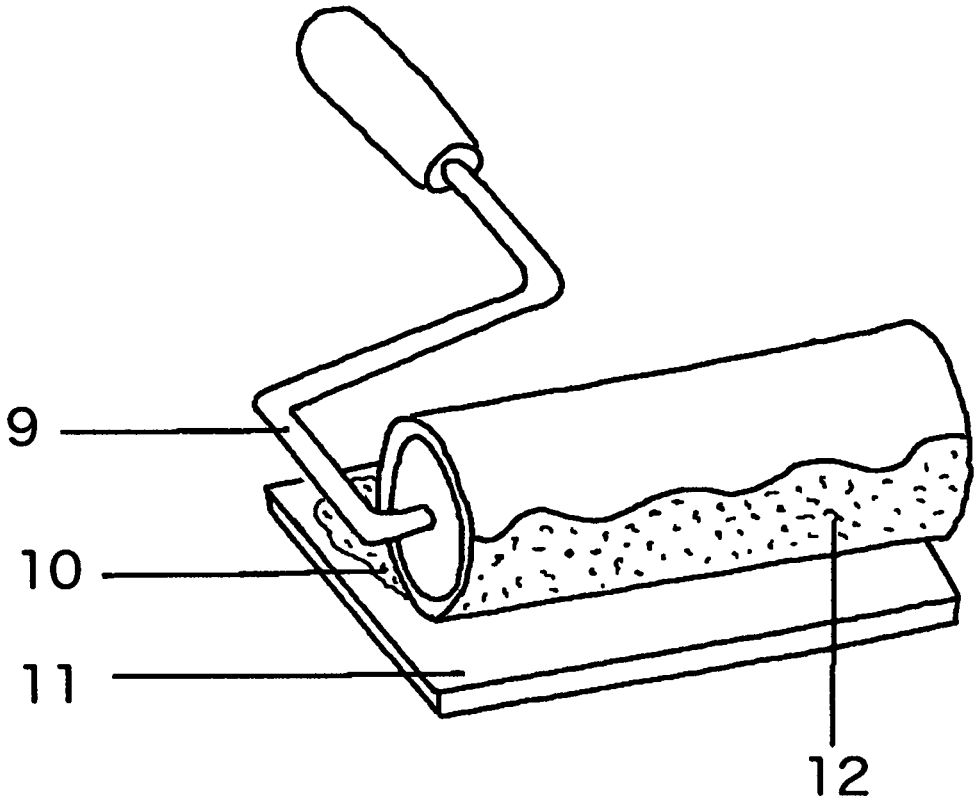
FIG. 3 is a drawing of a paint roller being rolled on an absorbent surface to emulsify and break paint particles from the bristles of the paint roller.

A similar method can be can be used with paint rollers FIG. 3 number 9 where the excess paint or contaminant is rolled from the paint roller and the paint roller is then sprayed with an encapsulating fluid. The roller is then rolled on an encapsulating fluid absorbent surface FIG. 3 number 11 , that breaks and encapsulates the paint or contaminant FIG. 3 number 12 from the roller bristles and carries the encapsulated paint particles or contaminates away FIG. 3 number 10. as the roller rolls over the absorbent surface. However, the fibers of the roller are not often tapered nor are they aligned as in a paint brush. Therefore the paint is not as easily forced to a tip where it can be wiped off but rather lies suspended in the encapsulating fluid. However, most of the encapsulated paint can be squeezed out between the roller and a firm surface. Then the remaining part of the encapsulating fluid can be absorbed from the roller by rolling it on an absorbent material such as a paper towel which removes the remaining paint or contaminant. This may or may not be needed depending on the next use of the roller. The user may elect to wash the encapsulating fluid out with soap and water or a suitable cleaner. Since most encapsulating fluids are by nature non volatile, they will not readily harden in the paint applicator and thus may be left there for an extended period.

To clarify, the present invention is a method to remove paint from a paint brush/roller. The apparatus uses an encapsulating liquid rather than the common solvent method where the paint is sequentially resolved into lesser and lesser concentrations. A paper towel or other like apparatus is used to squeeze the encapsulating agent into the brush FIG. 1 number 5. The thumb in FIG. 1 number 5 is further being shown massaging the brush bristles FIG. 1 number 3 and removing the paint from the bristles. A mechanical mechanism can be used to deliver hydraulic force to the paint on the bristles.

In an apparatus to clean a paint brush of embodiments of the invention, a comb (which may be constructed of wood or plastic or any other suitable durable material) is used to remove the paint from the bristles. In this configuration, the used brush is covered with or submerged in the emulsifying fluid formula and then combed or massaged with the distal edge of the comb.

Although referred to as a comb, the apparatus does not necessarily need tines when the brush is small enough, rather the leading edge of a tine less comb would still break the paint particles free and encapsulate them so they can be removed and the brush cleaned.

Also in this preferred embodiment the brush may be submerged in the encapsulating fluid and the encapsulating particles would sink to the bottom of the can thus cleaning the brush. Here the encapsulating fluid would be less dense than the particles to be removed from the brush, as for example with some latex paint being removed with canola oil. The encapsulated paint would simply be combed from the brush and collect in the bottom of the can of oil. One wipe with a paper towel and the brush can be put away clean. Residual canola oil remaining on the brush in experiments made by the inventor did not affect subsequent use of the brush.

Figure 4:
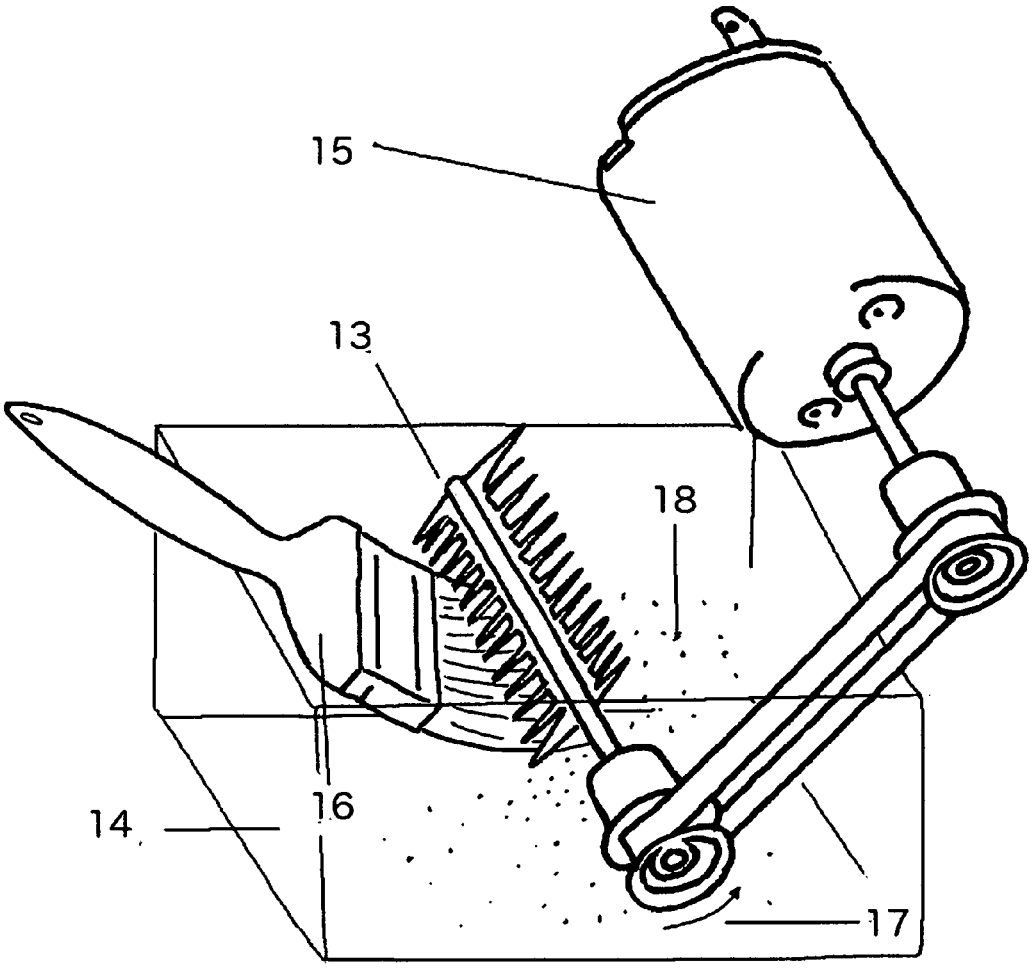
FIG. 4 is a drawing of a motorized comb cleaning apparatus using an emulsifying fluid where the brush bristles and comb are submerged in the fluid and the stripped paint collects in the bottom of the container.

The motorized apparatus for this is shown in FIG. 4. Usually the brush bristles and motorized comb FIG. 4 number 13, would be submerged in a emulsified fluid container, FIG. 4 number 14. A motor FIG. 4 number 15 is shown in turning comb FIG. 4 number 13 combing a large paint brush FIG. 4 number 16 suitable for motorized cleaning. FIG. 4 number 17 shows the direction of rotation of the comb to expel and remove the motor removed emulsified paint particles FIG. 4 number 18 which tend to be smaller than other methods.

The motorized comb would transfer through the emulsifying fluid a force dislodging the paint particles from the brush bristles where the emulsified paint would precipitate to the bottom of the container. The particles as they build up on the bottom of the container can be easily removed with a small sieve and the bulk of the fluid saved.

Figure 5:
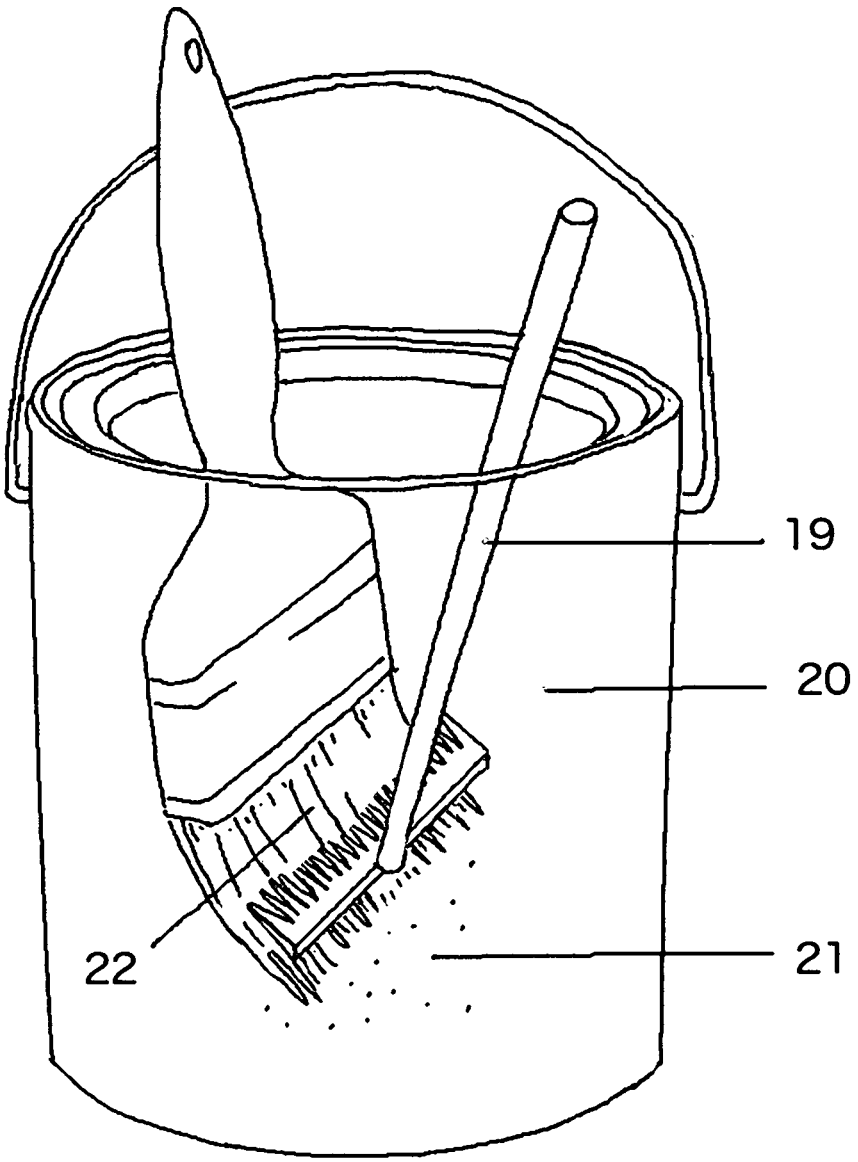
FIG. 5 is a drawing of a hand comb cleaning apparatus using an emulsifying fluid where the brush bristles and comb are submerged in the fluid and the stripped paint collects in the bottom of the container.

A hand operated apparatus is shown in FIG. 5. In this embodiment, a perpendicular mounted comb FIG. 5 number 19 is used to comb the flexed bristles of the paint brush FIG. 5 number 22 where they hit the bottom of the can FIG. 5 number 20. The see through (e.g. Lucite) can in this case is filled with an emulsifying fluid formula and the hand combed and thus larger paint particles FIG. 5 number 21 are seen floating to and collecting on the bottom of a clear see-through can. A siphon device could remove the larger emulsified particles from the can bottom thus preserving the fluid for further use.

To review the cleaning principle, upon finishing a painting job instead of going to a water hose to clean out the latex paint from the paint brush or roller, the user would just wipe the excess paint from the paint applicator back into the can. The user would then spray the brush/roller with common cooking oil (such as with a spray bottle or other like spray applicator) and take a paper towel and squeeze and manipulate the cooking oil into the brush/roller. This separates the paint from the bristles and breaks the paint into small particles much akin to dust. The tapered nature of paint brush fibers helps force the paint away from the brush ferrule and out on to the paper towel, although this method will also work with non tapered brush bristles. The user would typically repeat the process two or more times especially in a larger brush and use maybe approximately two or three tablespoons of vegetable oil to clean a large brush or roller. This way of cleaning bristles is not only faster and cleans the bristles better but it also does not contaminate the ground with non biodegradable particles of paint or, in the case of oil paint or varnish, with large quantities of paint thinner. We use the term of Dab (with the paper towel), Spray (with vegetable oil), and Put Away when experimenting with the present invention Another important aspect of this invention is the biodegradable nature of the process. The breaking of the paint into particles and surrounding it with vegetable oil (such as corn or canola oil) described herein has the advantage of making the paint particles and cleaning fluid biodegradable by increasing the surface area of the paint by the act of breaking it to dust particle size and further sustaining biological activity with the vegetable oil.

Definitions:

Bristles are the fiber hair like part of a paint brush attached often with a ferrule to the handle in the case of a paintbrush or the tube of a roller.

Brush ferrule is the often metal or plastic band that separates the brush bristles from the brush handle.

Comb, although referring to a rake like instrument where the tines are perpendicular to the handle so as to remove paint from a brush with its bristles submerged in the can, the comb could be a tine less edge with a handle to facilitate the movement of paint particles more readily from the brush or roller.

Contaminant refers to anything that is to be removed from a brush whether it be a liquid paint or a fine dust or any similar material.

Massaging is the manipulation of the encapsulating fluid whereby hydraulic force urges the shearing or breaking away of any paint or contaminant from the paint bristles surfaces.

Paint refers to common paint or anything that can be painted on to a surface. Paint can be considered a contaminant when it is finished being used.

Paper towels refer to any absorbent material such as rags or sponges or even saw dust or such material.

Hydraulic force is the transfer of mechanical force to the encapsulating fluid to the paint particles attached to the bristles from the squeezing of the paper towel or other mechanical means.

Non solvent refers to the encapsulating fluid that can be any number of materials which creates an emulsion with the paint being the immiscible liquid/solid suspended within the mixture. The non solvent suspending liquid may have limited solvent properties for certain constituent parts of the paint but will encapsulate the major part of the paint.

Encapsulates refers to the action where paint or contaminants are separated from the bristles of the applicator into smaller pieces and surrounded by said fluid. The particles become dust like in that they do not tend to stick together again once separated.

Encapsulating fluid cleaner could be as simple as soap and water to remove an oil type of encapsulating fluid as shown in the preferred embodiment but could also include any number of solvents or cleaners.

Wiping action refers to the action of squeezing, massaging and rubbing the brush to force the non solvent to break apart the contaminants or paint.

Spraying is the application of the non solvent encapsulating agent to the paint brush whereby the action contributes to the removal of paint from the fibers of the brush and replaces it with the non solvent.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

I claim:

1. A method of cleaning brush bristles, said brush bristles each comprising a proximal end attached to a brush handle via a ferrule and a distal end opposite said proximal end, said method comprising:

a. Applying an encapsulating fluid to said brush bristles wherein said encapsulating fluid is a non solvent of a paint being removed from said brush bristles, wherein said encapsulating fluid has a high bulk modulus, wherein said encapsulating fluid is non volatile, and wherein said encapsulating fluid can create an emulsion where it surrounds particles of said paint being removed; and b. Massaging said encapsulating fluid into said brushes bristles; wherein said encapsulating fluid through hydraulic action breaks an attachment of contaminant particles from said brush bristles and encapsulates said contaminant particles; and wherein said massaging urges said contaminant particles away from said proximal ends of said brush bristles and toward said distal ends of said brush bristles and off said brush, thus cleaning said paint brush.

2. The method of claim 1, wherein said encapsulating fluid remains on said brush bristles thus preventing paint from attaching to said brush bristles.

* * * * *